United States Patent [19]

Iba

[11] 4,413,543

[45] Nov. 8, 1983

[54] SYNCHRO START DEVICE FOR ELECTRONIC MUSICAL INSTRUMENTS

[75] Inventor: Akio Iba, Tokorozawa, Japan

[73] Assignee: Casio Computer Co., Ltd., Tokyo, Japan

[21] Appl. No.: 331,972

[22] Filed: Dec. 18, 1981

[30] Foreign Application Priority Data

Dec. 25, 1980 [JP] Japan ..... 55-185268

[51] Int. Cl.[3] ..... G10H 1/42; G10H 7/00

[52] U.S. Cl. ..... 84/1.03; 84/1.28; 84/DIG. 12

[58] Field of Search ..... 84/1.01, 1.03, DIG. 12, 84/1.28

[56] References Cited

U.S. PATENT DOCUMENTS 4,314,493 2/1982 Kondo ..... 84/1.03

4,357,854 11/1982 Hirano ..... 84/1.03

*Primary Examiner*—S. J. Witkowski

*Attorney, Agent, or Firm*—Frishauf, Holtz, Goodman & Woodward

[57] ABSTRACT

A series of musical tone codes for musical performances and synchro start codes are stored in a main memory. A series of musical tone codes for one-key play or an automatic play are stored in a submemory. In the course of playing music on the basis of said musical tone codes read out from the main memory, when the synchro start code is read out, an automatic play on the basis of musical tone codes stored in the submemory is performed accompanied by the musical tone codes stored in the submemory under control of a CPU, if necessary.

13 Claims, 14 Drawing Figures

| CODE | OCTAVE |
|---|---|
| 0 0 | FIRST OCTAVE |
| 0 1 | SECOND OCTAVE |
| 1 0 | THIRD OCTAVE |
| 1 1 | 4TH OCTAVE |

| CODE | NOTE |
|---|---|
| 0000 | C |
| 0001 | C# |
| 0010 | D |
| 0011 | D# |
| 0100 | E |
| 0101 | F |
| 0110 | F# |
| 0111 | G |
| 1000 | G# |
| 1001 | A |
| 1010 | A# |
| 1011 | B |

| | |
|---|---|
| 0 0 1 1 0 0 | SYNCHRO-START |

| KEY OPERATION | M1 FLAG | M2 FLAG |
|---|---|---|
| S7 S4 M1 HEAD | 1 1 1 1 | 0 0 0 0 |
| S8 S4 M2 HEAD | 0 0 0 0 | 1 1 1 1 |
| S7 S8 S4 M1 M2 HEAD | 1 1 1 1 | 1 0 0 0 |
| S8 S7 S4 M2 M1 HEAD | 1 0 0 0 | 1 1 1 1 |

| OCTAVE | NOTE | TONE DURATION |
|---|---|---|

FIG. 9
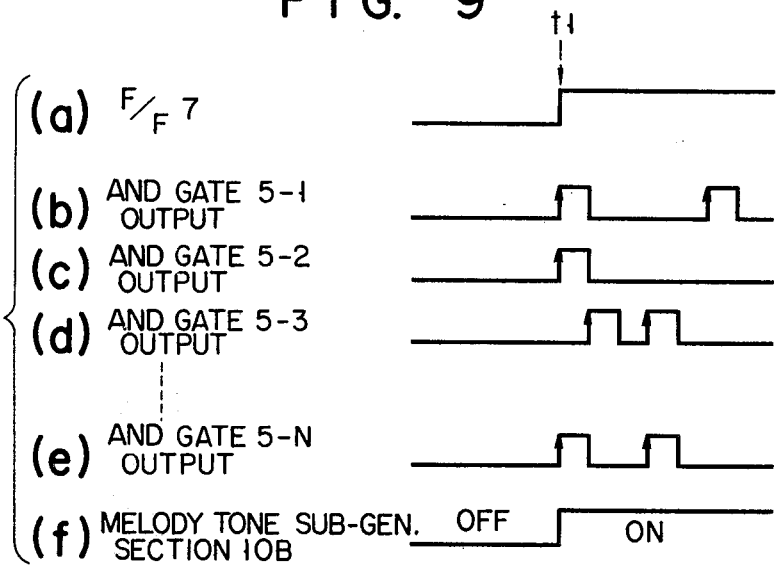
FIG. 10
| CHORD FLAG | OCTAVE | NOTE | TONE DURATION |
|---|---|---|---|
FIG. 11
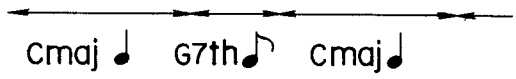

SYNCHRO START DEVICE FOR ELECTRONIC MUSICAL INSTRUMENTS

BACKGROUND OF THE INVENTION

The present invention relates to a synchro start device for electronic musical instruments.

Some keyboard type electronic musical instruments contain rhythm boxes for rhythm performance. In this the musical instrument, a player plays music in synchronism with the rhythm sounds which are produced from the rhythm box independently of the keying operation by the player, while hearing the rhythm sounds. In advanced musical instruments of this type, a synchronizing function is provided to produce the rhythm sounds in synchronism with the key operation by a player.

Synchro start function is thus far provided not in electronic musical instruments, of the automatic play type, in which musical tone codes such as pitch codes are preset in a memory, and electronic musical instruments of the semi-automatic play type, or one-key play type, in which the address in a memory is stepped by operating a specific key and a musical tone is produced during a time that the specific key is in the ON state. Therefore, the performance by these musical instruments is unsatisfactory.

SUMMARY OF THE INVENTION

Accordingly, an object of the present invention is to provide a synchro start device for electronic musical instruments which allows a player to play music pleasantly by using the one-key type or automatic play type electronic musical instrument, not to mention to the keyboard type musical instrument.

To achieve the above object, there is provided a synchro start device for electronic musical instruments comprising: a main memory for storing a series of musical tone codes and another series of synchro start codes, a submemory for storing a series of musical tone codes, a rhythm sound generating section optionally provided, and control means which performs music on the basis of the contents of the main memory and which starts an automatic performance on the contents of the submemory in response to a synchro start code when it is read out, and which starts the rhythm sound generating section, if necessary.

BRIEF DESCRIPTION OF THE DRAWINGS

FIG. 9 shows a time chart for illustrating the states of related components in the synchro start device at the time of the synchro start of the rhythm performance and the automatic performance;

FIG. 10 illustrates a state of the memory when chord data is inputted into the memory; and FIG. 11 illustrates chords produced on the basis of the chord data as shown in FIG. 10.

DETAILED DESCRIPTION OF THE PREFERRED EMBODIMENT

An embodiment of a synchro start device according to the present invention will be described referring to the accompanying drawings.

Figure 1:
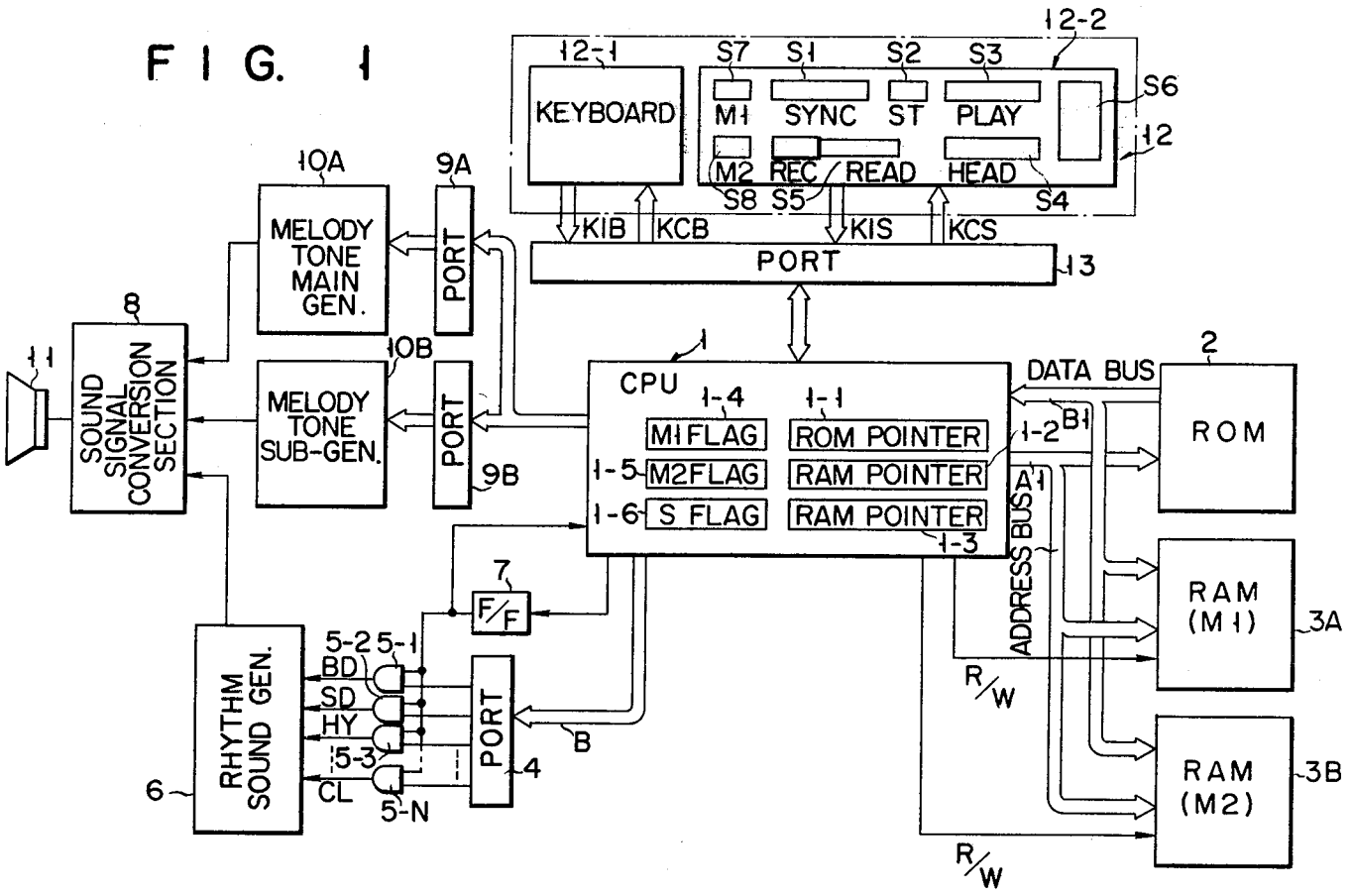
FIG. 1 is a block diagram of an embodiment of a synchro start device for electronic musical instruments according to the present invention.

FIG. 1 illustrates an arrangement of an electronic musical instrument incorporating a synchro start device according to the present invention, a central processing unit (CPU), which is formed by a microprocessor, for example, controls of the electronic musical instrument of the present embodiment. The CPU 1 contains a main memory ROM (read only memory), a RAM (random access memory), and an arithmetic circuit, including adders and the like (those components are not shown). A ROM pointer 1-1 and RAM pointers 1-2 and 1-3 are further contained. These pointers 1-1, 1-2 and 1-3 are used for designating addresses in an external ROM 2, and external RAMs 3A and 3B, respectively. The CPU 1 further contains flag registers M1 flag 1-4, M2 flag 1-5, and S flag 1-6, which will be described later.

The ROM 2, connected to the CPU 1, a data bus B1, and an address bus A1, stores the rhythm pattern data for producing rhythm sounds such as rock, waltz, march, etc. A desired rhythm pattern data is selected by a rhythm select switch S6 to be described later. The RAMs 3A and 3B, coupled with the CPU 1 through the data bus B1 and the address bus A1, are supplied with a read/write signal R/W from the CPU 1. The RAMs 3A and 3B store only pitch data, or pitch data and tone duration data, as will be described later, and further store a synchro start code.

The contents of the ROM 2 are transferred through the data bus B2 to a port 4 under control of the CPU 1. The rhythm pattern data stored in the port 4 is supplied to a rhythm sound generating section 6, through AND gates 5-1, 5-2, . . . , 5-N.

The output signal from a flip-flop 7 of which the contents is "1" or "0" in accordance with a control signal produced from the CPU 1. When the output signal from the flip-flop 7 is "1", the rhythm pattern data is supplied to the rhythm sound generating section.

The output signal from the flip-flop 7 is further connected to the CPU 1 for the control following the synchro start.

The AND gates 5-1, 5-2, 5-3, . . . , 5-N, respectively, correspond to bass drum, snare drum, high hat, . . . , claves sounds, as rhythm sounds (percussion instrument sounds). These rhythm sounds are produced when the output signals from the corresponding AND gates go from "0" to "1".

The rhythm sound generating section 6 is comprised of an analog circuit or a digital circuit for producing signals corresponding to the sounds of the percussion instrument. The rhythm sound signals are subjected to a mixing process and then transmitted to a sound signal conversion section 8.

The CPU 1 transfers the contents from either of the RAMs 3A and 3B to ports 9A and 9B. A melody tone subgenerating section 10A generates a musical tone in accordance with an output signal from the port 9A. A melody tone subgenerating section 10B generates a musical tone in accordance with an output signal from the port 9B. The musical tone signal from each of the generators is applied to the tone signal conversion section 8. In the present embodiment, the melody tone signal generating section 10A is capable of forming a musical tone according to a key depressed on a keyboard to be described later.

The tone signal conversion section 8 mixes the output signals from the rhythm tone generating section 6, the melody tone main generating section 10A, and the melody tone subgenerating section 10B, and amplifies the mixed one for transmission to a loudspeaker 11, thereby to sound the loudspeaker.

The CPU 1 in the present embodiment detects key operations in a key-in section 12 for processing the signals from the keys depressed. Specifically, the CPU 1 applies a signal to scan the key switches on the key-in section 12, and the port 13 returns a key signal as the result of the scanning. The port 13 produces a signal KCB for scanning a keyboard 12-1 with a plurality of a key and the keyboard 12-1 produces an on/off signal KIB of keys on the keyboard. The port 13 further produces a signal KCS for scanning a switch section 12-2 and the switch section 12-2 produces an on/off signal KIS of each switch.

The switch section 12-2 is comprised of push button switches such as a synchro start switch S1, a start/stop switch S2, a play switch S3, a head switch S4, etc., and a slide switch S5 with positions "REC" and "READ", a rhythm select switch S6, and an M1 switch S7 and an M2 switch S8 for designating the RAMs 3A and 3B.

The synchro start switch S1 is operated before the performance, for synchro-starting the rhythm play in synchronism with the key operations on the keyboard 12-2 in a normal play mode (except an automatic play or a one-play mode). In an automatic play or one-play mode, the switch S1 is used for previously storing the synchro start code in the RAMs 3A and 3B.

The start/stop switch S2 is used for initializing the addresses in the RAMs 3A and 3B before the automatic play mode starts, and stops the automatic play mode.

The switch S3 sequentially increments the addresses of the RAMs 3A or 3B in a one-key play mode. Music is sounded during the period that this switch S3 is depressed. For storing the data to perform the automatic play into the RAMs 3A and 3B, the tone duration of a musical tone of a note specified by the keyboard 12-1 is set to the duration of the depression of the switch.

The head switch S4 designates the head addresses of the RAMs 3A and 3B. The slide switch S5 has two mode positions for "REC" (record) and "READ" (read out). At the position of the "REC" mode, the note data is stored into either of the RAMs 3A and 3B through the operation of the keyboard 12-1. At the position of the "READ" mode, the contents of the RAMs 3A and 3B are read out for the automatic play or the one-key play. In the one-key play mode, the tone duration data may be stored during the ON time of the play switch S3.

The rhythm selection switch S6 specifies an area of the ROM 2 to be read out to select one of a plurality of rhythm patterns to make the rhythm play.

The switch section 12-2 may further be provided with a switch [illegible] for inputting a rest and a switch [illegible] for directing a repeat play. Additionally, the switch section 12-2 may be provided with keys [illegible], [illegible] and [illegible] for keying in note durations, and keys [illegible], [illegible] and [illegible] for inputting rest durations. By operating those switches, the note durations and the rest durations may be keyed in.

The operation of the present embodiment will be described. How to store the data of a musical piece into the RAM 3A will first be described.

Figure 2:
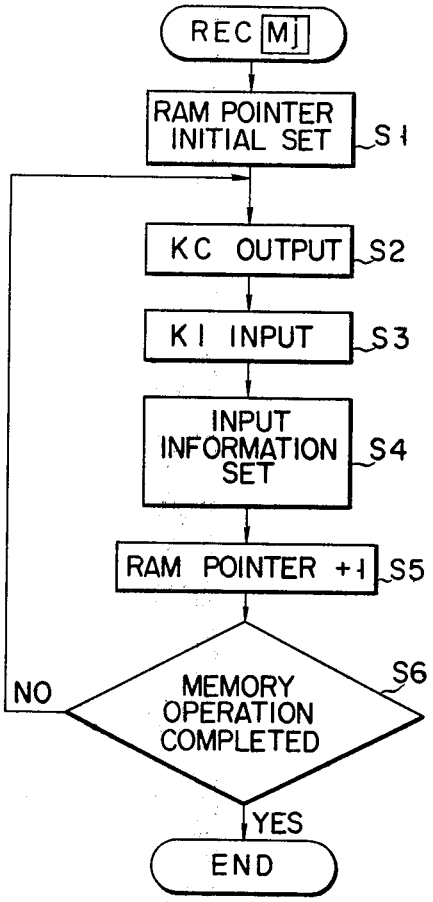
FIG. 2 shows a flow chart for storing musical pieces into a memory in the synchro start device shown in FIG. 1.

Firstly, the slide switch S5 in the switch section 12-2 is set to the "REC" position, and the M1 switch S7 is turned on. In response to a signal from the port 13, the CPU 1 is set so as to execute the operation of a flow chart shown in FIG. 2. All "1's" code, for example, is set in the M1 flag 1-4 in the CPU 1 and all "0's" code, for example, is set in the M2 flag 1-5. As a result, the CPU 1 controls the input of the musical tone code into the RAM 3A.

The flow chart illustrates the operation for storing the pitch data of a music piece. Upon the operation of the head switch S4, the program advances to a step S1 to initialize the RAM pointer 1-2 in the CPU 1. Accordingly, the address data applied through the address bus A1 to the RAM 3A represents an initial state. In a step S2, the CPU 1 transmits to the port 13 signals KCB and KCS for scanning the keyboard 12-2 and the switch section 12-2. The CPU 1 fetches the resulting key operation signals KIB and KIS, in a step S3.

When any one of the keys on the keyboard 12-1 is operated, the data is applied to the RAM 3A through the data bus B1. Upon a logical state "1" of the read/-write signal R/W, the data is set in the RAM 3A. In a step S4 shown in FIG. 2, the code data stored in the RAM 3A is as shown in FIGS. 3A and 3B.

Figures 3A, 3B, 3C, 4:
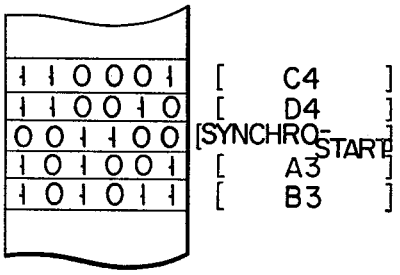
FIGS. 3A through 3C show code tables illustrating codes stored in the memory.
FIG. 4 illustrates code data actually stored in the memory.

The keys on the keyboard 12-1 are arranged corresponding to four octaves, and each octave is designated by a 2-bit data, as shown in FIG. 3A. The notes C to B are designated by 4-bit data "0000" to "1011", as shown in FIG. 3B. Thus, each key is expressed by the total data, or 6-bit data, of the octave and the note. After the write operation of the step S4 is completed, the program advances to a step S5 to increment by one the contents of the RAM pointer 1-2. Then, in the next step S6, it is judged whether the write operation is completed or not. The judgment in the step S6 is made when the slide switch S4 is switched to the contact "READ" or the memory area of the RAM 3A is completely cleared. In this case, the judgment gives "NO" and the program returns to the step S2.

Subsequently, the keys on the keyboard 12-1 are turned on in accordance with the noted in the musical piece (in this case, the note duration is negligible). With the ON operations, the note data is progressively set in the RAM 3A through the execution of the steps S2 to S6. In this case, although not illustrated in the flow chart, the notes correponding to the operations of the keys on the keyboard are produced from the melody tone main generating section 10A under control of the CPU 1 and are sounded through the loudspeaker 11. A player hears for confirmation the pitch of the musical tone set in the RAM 3A.

Repeating the steps S2 to S6, the pitch data of the musical piece are successively stored in the RAM 3A. When a synchro start code (see FIG. 3C) for starting the automatic play and the rhythm play is stored in a certain address, the synchro switch S1 in the switch section 12-2 is operated.

After the operation of the synchro switch S1 is detected at the step S3, CPU 1 makes the corresponding address of RAM 3A store the synchro start code "001100" at the step S4. Then, in the step S5, the RAM pointer 1-2 is incremented by +1 to advance the address.

Subsequently, the pitch codes are sequentially set in the RAM 3A through the operation of the keyboard 12-1 in a similar way. In addition to the operation data of the keyboard 12-2 and the synchro start switch S1, the data of the switches and allotted to the codes may be stored in the RAM 3A.

The code data is sequentially stored in the RAM 3A, as shown in FIG. 4, and the write operation mode is completed.

The musical tone code associated with the data of the musical piece stored in the RAM 3A is stored into the RAM 3B. The data of the musical piece stored in the RAM 3B is for the automatic play starting in the course of the playing the musical piece stored in the RAM 3A.

For inputting the data into the RAM 3B, the slide switch S5 in the switch 12-2 is set to the "REC" position, and the M2 switch S8 is turned on. As a result, the CPU 1 responds to the signal from the port 13 to execute the sequence of the operations shown in FIG. 2. Additionally, all "1's" code is set in the M2 flag 1-5 in the CPU 1 and all "0's" code is set in the M1 flag 1-4.

Following the operation of the head switch S4, the keyboard 12-1 and the switch section 12-2 are sequentially operated to input the pitch code or the synchro start code into the RAM 3B. When the RAM 3A is used as a main memory and the RAM 3B as a submemory, the synchro start signal code inputted into the RAM 3B is neglected in the one-key play mode or the automatic play mode, as will be described later. Assume now that the synchro start code is not inputted into the RAM 3B.

After the note code, and the like is inputted into the RAMs 3A and 3*b* in this way, the tone duration code is inputted into the RAM 3B while performing the one-key play on the basis of the contents of the RAM 3B, thereby to form musical piece data for the automatic play.

In this case, the slide switch S5 is shifted to the "READ" position, the M2 switch S8 is turned on, and the head switch S4 is turned on.

Figure 5A:
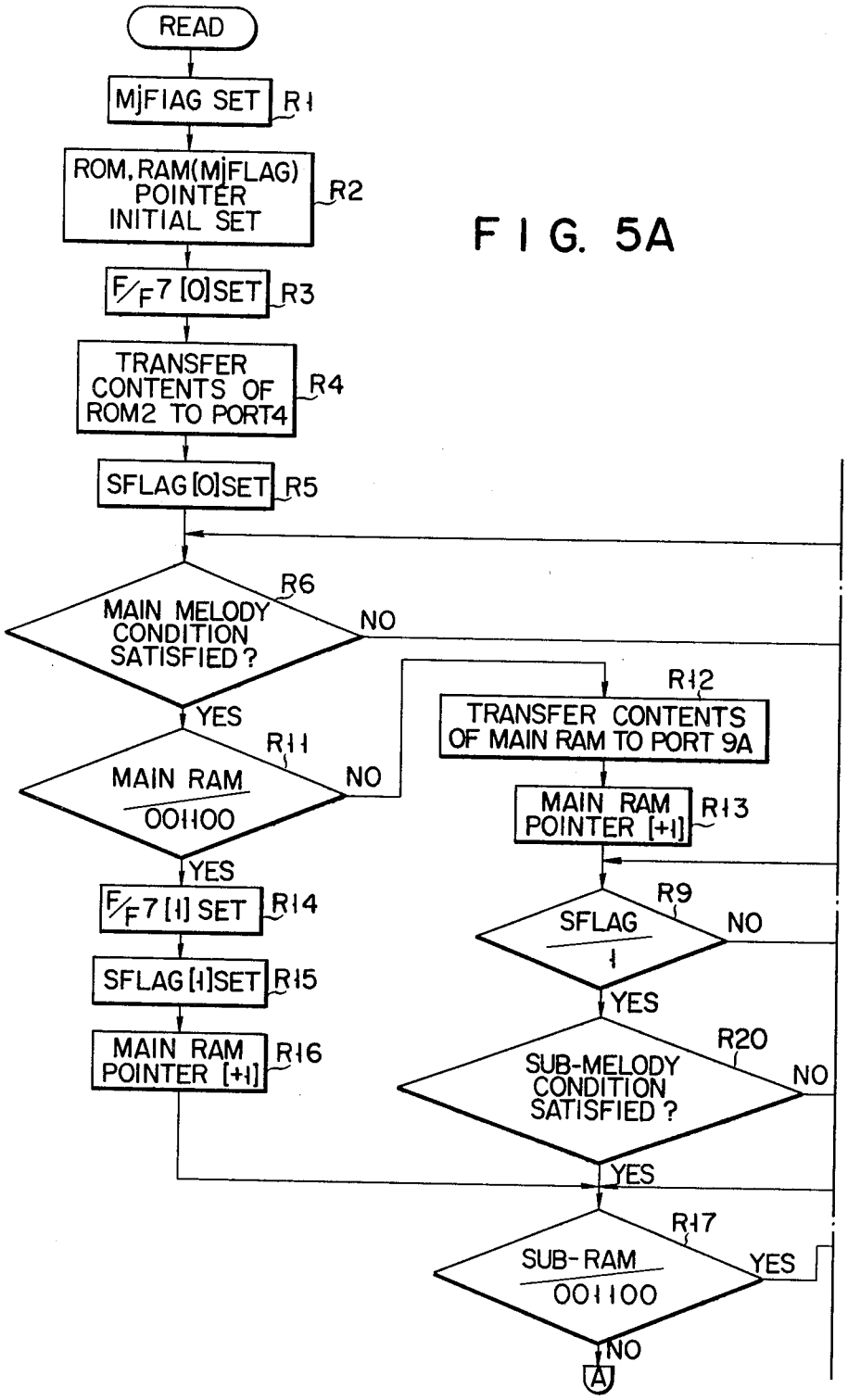
FIGS. 5A and 5B shows a flow chart for illustrating a process flow when the code data stored in the memory is read out and the one-key or automatic performances.
Figure 5B:
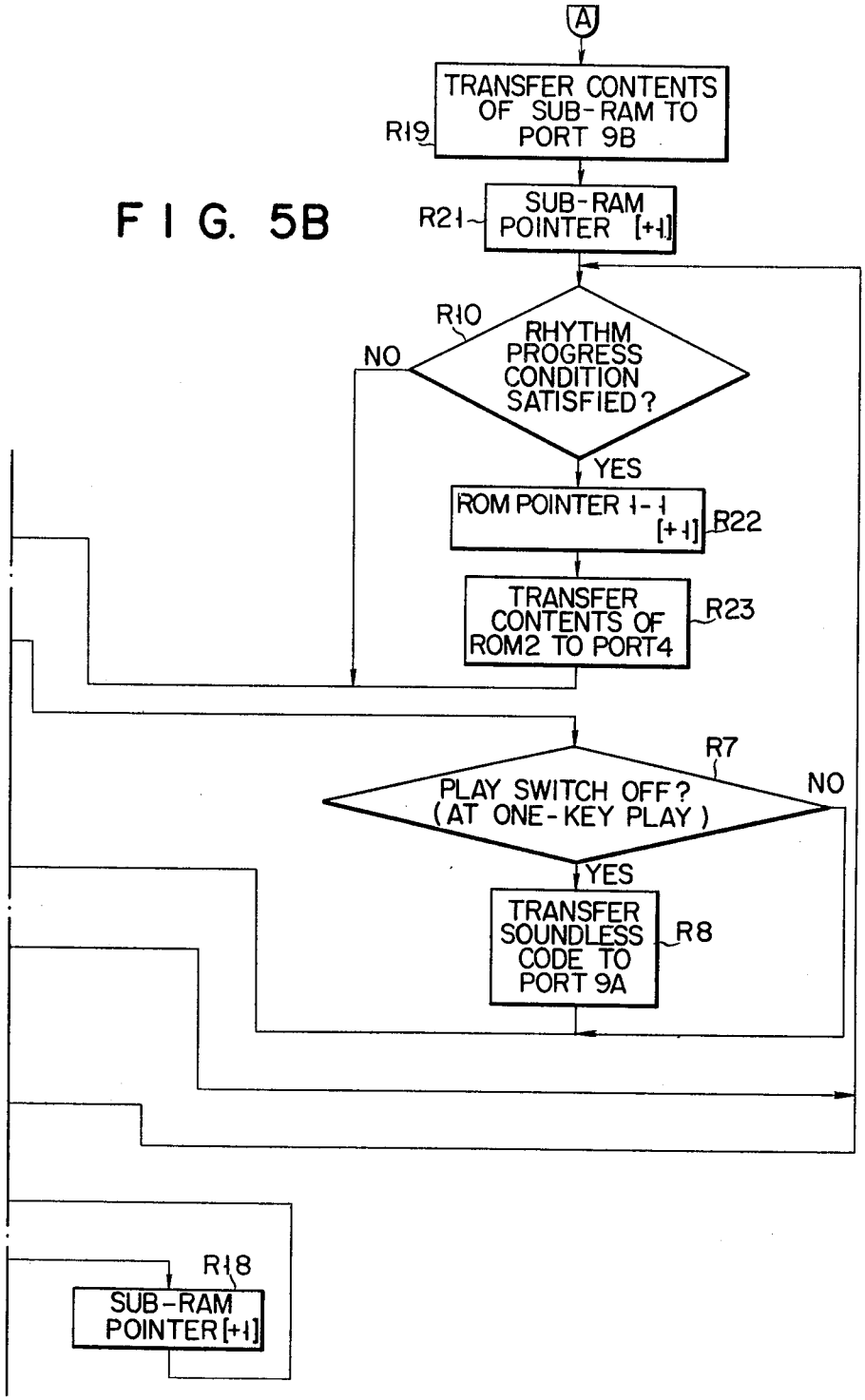

As a result, the one-key play is conducted in accordance with the flow chart shown in FIGS. 5A and 5B.

Figures 6, 7, 8:
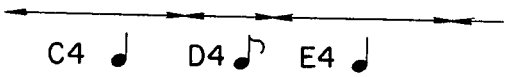
FIG. 6 tabulates the contents of flags representing key operations for selecting a main memory and a submemory in the synchro start device shown in FIG. 1.
FIG. 7 shows a state of the memory when a tone duration code is additionally stored.
FIG. 8 shows musical tones produced when the automatic performance is conducted on the basis of the data inputted as shown in FIG. 7.

As shown in FIG. 6, 4-bit all "0's" code and 4-bit all "1's" code are set in the M1 flag 1-4 and M2 flag 1-5 in the CPU 1, respectively. This process is executed in a step R1 in FIG. 5A. According to the operation of the head switch S4, a step R2 is executed to initialize the ROM pointer 1-1 and RAM pointer 1-3. The ROM pointer 1-1 is set at the address location specified by the rhythm selection switch S6.

Following the step R2, a step R3 is executed to clear the contents of the flip-flop 7 to zero. Then, in a step R4, the contents in the ROM 2 is transferred to the port 4. In this case, however, the output signal from the flip-flop 7 is "0", so that the rhythm play on the basis of the rhythm pattern data transferred to the port 4 is not performed.

Then, the CPU advances to a step S5 to set "0" in the S flag 1-6, which drives the submemory to start the automatic play. In this case, since only the RAM 3B is designated, only the play on the basis of the data from the main memory (i.e. the RAM 3B) is conducted.

A step R6 is then executed, in which whether or not the play switch S3 is newly turned on is detected. When it is not turned on, a step R7 is executed to detect on or off of the play switch S3.

In this case, the CPU shifts to a step R8, so that no note code (e.g. all "1's" code) is transmitted to the port 9A, to inhibit the generation of the musical tone. The no tone code is always applied to the port 9B by the CPU 1.

The CPU advances to a step R9. In this case, since the S flag 1-6 is "0", the CPU further advances to a step R10. The step R10 detects whether the output signal from the flip-flop 7 is "1" or not and whether a given time lapses or not for progressing the rhythm. When the output signal from the flip-flop 7 is "1" and the given time lapses, the judgment is "YES".

In this case, the CPU 1 judges to give "NO" and advances to the step R6. In this way, the sequence of the operations from the steps R6 to R10 is repeated until the play switch S3 is turned on, and then the CPU 1 is in a standby state.

In the step R6, when it is detected that the play switch S3 is turned on, the CPU 1 proceeds to a step R11. The step R11 judges whether the contents in the memory area of the RAM 3B specified by the RAM pointer 1-3 is the synchro start code "001100" or not. In this case, since the synchro start code is not stored in the RAM 3B, the judgment is "NO". Then, the CPU 1 proceeds to a step R12. In the step R12, the CPU 1 reads out the contents of the RAM 3B (the contents of the head address) and transfers the contents to the port 9A. As a result, the melody tone main generating section 10A receives a given octave code and a note code, thereby to form and produce a corresponding musical tone signal.

Accordingly, the music tone signal is converted into an audio signal by the sound signal conversion section 8 and is sounded through the loudspeaker 11. The musical tone signal is continued until the contents of the port 9A is changed.

Then, the CPU 1 advances to a step R18 to increment the contents of the RAM pointer 1-3 by one. Then, the CPU 1 returns to the step R9 to check whether the rhythm progress condition is satisfied or not.

In this example, the step R10 provides "NO", and the CPU returns to the step R6. At this time, the play switch S3 is still depressed, and then the judgment of the step R6 is "NO". Further, the step R7 provides "NO", and the step R9 is executed.

Similarly, during the time that the play switch S3 is depressed, the steps R6, R7, R9 and R10 are repeated. When the first ON operation of the play switch S3 is released, the "YES" is given in the step R7, then the step R8 is executed where the non-tone code is transferred to the port 9A to stop the first musical tone output.

The executions of the steps R6, R7, R8, R9 and R10 are repeated until the play switch S3 is newly depressed.

When the play switch S3 is operated again, the step R6 provides the judgment of "YES". Accordingly, the CPU 1 proceeds to the step R11. At this time, since the contents of the RAM 3B is not synchro start code, the step R12 is executed following the step R11. Accordingly, in the step R12, the contents of the second address location are transferred through the CPU 1 to the port 9A to form and output a corresponding musical tone.

Then, the program execution shifts from the step R12 to a step R13. Subsequently, the steps R6, R7, R9 and R10 are repeated until the play switch S3 is executed.

With the progress of the one-key play, the CPU 1 counts the depression time of the play switch S3 and transfers time duration data to the addresses of the RAM 3B, while at the same time, the CPU 1 sets the read/write signal to a state of the write mode, and progressively inputs the octave code, the note code and the tone duration code into the memory, as shown in FIG. 7. This operation is not shown in the flow chart of FIGS. 5A and 5B.

Into the RAM 3B, the pitch code and the tone duration code, as shown in FIG. 8, are stored in succession.

Subsequently, the one-key play is performed on the basis of the contents of the RAM 3B and the tone duration code is inputted to each address of the memory. At this point, the present mode ends.

In the operation of the electronic musical instrument to be described, the RAM 3A is used for the main memory and the RAM 3B for the submemory. The one-key play is performed on the basis of the contents of the main memory. In the course of the one-key play, the automatic play dependent on the contents of the submemory, or the memory RAM 3B, starts at a time point that the synchro start code is read out from the RAM 3A. At the same time, the automatic rhythm play on the rhythm pattern stored in the ROM 2 starts.

In this case, the slide switch S5 is set to the "READ" position, and then the M1 switch S7, the M2 switch S8 and the head switch S4 are turned on in succession.

As a result, the process progresses on the basis of the flow chart shown in FIGS. 5A and 5B, as mentioned above.

All "1's" code of 4 bits and "1000" code are, respectively, inputted into the M1 flag 1-4 and the M2 flag 1-5 in the CPU 1 in accordance with the key operation, as shown in FIG. 6. This process is performed in the step R1 in the flow chart shown in FIGS. 5A and 5B. And according to the operation of the head switch S4, the step R2 is performed and the ROM pointer 1-1, and the RAM pointers 1-2 and 1-3 are initialized. The ROM pointer 1-1 is set to an address location designated by the rhythm select switch S6.

The step R3 follows the step R2. In the step R3, the contents of the flip-flop 7 is cleared to "0". Then, in the step R4, the contents of the ROM 2 are transferred to the port 4. In this case, however, the output signal from the flip-flop 7 is "0", and hence the rhythm play dependent on the rhythm pattern data transferred to the port 4 is not performed.

Then, the program proceeds to the step R5 to set "0" into the S flag 1-6.

Then, the step R6 is executed. In the R6, it is detected whether the play switch S3 is turned on or not. When the play switch S3 is not turned on, the step R7 is executed to check the on/off state of the play switch S3.

In the process flow under discussion, non-tone code is transferred to the port 9A to prohibit the generation of the musical tone. The non-tone code is applied to the port 9B by the CPU 1.

The CPU 1 advances to the step R9. In this example, since the S flag 1-6 is "0", the CPU goes to the step R10.

In the step R10, the judgment of "NO" is made by the CPU 1. In this way, the steps R6, R7, R8, R9 and R10 are executed repeatedly and the CPU 1 is in a standby state.

In the step R6, when it is detected that the play switch S3 is ON, the CPU proceeds to the step R11. In this step, the CPU 1 judges whether the contents of the memory area of the RAM 3A specified by the RAM pointer 1-2 is the synchro start code "001100" is not. Since its contents are not the synchro start code, the judgment by the CPU is "NO", and the step R12 is executed.

In the step R12, the contents (the contents of the head address) of the RAM 3A are read out and transferred to the port 9A. As a result, the melody generating section 10A receives a given octave code and a given note code, to produce a corresponding musical tone signal.

The musical tone signal is applied to the sound conversion section 8 where it is converted into an audio signal which in turn is sounded through the loudspeaker 11. The sounding of the musical tone continues until the contents of the port 9A is changed.

Then, the CPU 1 advances to the step R13 to increment the contents of the RAM pointer 1-2 by one. Then, it advances to the step R9, and further to the step R10 to check whether the rhythm progress condition is satisfied or not.

In the step R10, the CPU 1 provides the judgment of "NO" and returns to the step R6. At this time, the play switch S3 is still depressed, so that the CPU 1 gives "NO" in the step R7 and also in the step R8, and then advances to the step R9.

Subsequently, the steps R6, R7, R9 and R10 are repeated so long as the play switch S3 is depressed. When the first ON state of the play switch S3 is released, the judgment of "YES" is made in the step R7. Then, the CPU advances to the step R8 to transfer the non-tone code to the port 9A, to stop the outputting of the first musical tone.

The steps R6, R7, R8, R9 and R10 are repeatedly performed until the play switch S3 is depressed.

When the play switch S3 is depressed again, the judgment of "YES" is made in the step R6. Accordingly, the CPU 1 advances to the step R11 and to the step R12 since the contents of the RAM 3A is not the synchro start code. Accordingly, in the step R12, the contents at the second address location is transferred from the RAM 3A through the CPU 1 to the port 9A, to form and produce a corresponding musical tone.

The CPU proceeds from the step R12 to the R13, and the execution of the steps R6, R7, R9 and R10 are repeated until the play switch S3 is turned off. When the play switch S3 is turned off, the sequence of the executions of the steps R6, R7, R8, R9 and R10 repeats, similarly.

As shown in FIG. 4, when the synchro start code "001100" is read out from a memory location of the RAM 3A, the step R14 is executed following the step R11, to set the flip-flop 7 to "1". As a result, the AND gates 5-1 to 5-N shown in FIG. 1 are enabled to allow the rhythm pattern data from the port 4 to go the the rhythm sound generating section 6. Accordingly, a rhythm sound is produced starting at time t1 in response to the rhythm pattern signal specified by the rhythm selection switch S6, as shown in FIG. 9, thereby producing the rhythm sound through the sound conversion section 8 and the loudspeaker 11.

In the step R15 following the step R14, the S flag 1-6 in the CPU 1 is set to a "1" state. Then, the step R16 is executed to step the contents of the RAM pointer 1-2. If the control program of the CPU 1 is changed so that the CPU 1 automatically advances from the step R16 to the step R12, the pitch code of the next musical tone may also be read out when the synchro start code is read out by operating the play switch S3.

In the present example, the step R17 follows the step R16. In the step R17, it is judged whether the contents (the head address) of the RAM 3B as the submemory is a synchro start code or not. If the contents are the synchro start code, the CPU 1 advances to the step R18 to step the RAM pointer 1-3 and returns to the step R17. The processes of the steps R17 and R18 are for stepping the pointer to the next address when the synchro start code is in the submemory, neglecting the contents thereof.

As described above, the synchro start code is not stored in the RAM 3B, the judgment in the step R17 is always "NO", and the CPU advances to the step R19.

In the step R19, the CPU 1 transfers the pitch code of the contents of the address of the RAM 3B to the port 9B. The count operation on the basis of the tone duration code in the corresponding address starts in the counter in the CPU 1. That the result of the counting represents the tone duration of the musical tone is detected by a step R20 to be given later.

In the step R19, the musical tone dependent on the pitch code transferred to the port 9B is generated in the melody subgenerating section 10B, thereby to be sounded through the sound conversion section 8, and the loudspeaker 11.

A step R21 is executed after the step R19, to increment by one the RAM pointer 1-3. Then, the step R10 is executed to check whether the rhythm progression condition is satisfied or not.

When the CPU 1 knows that the given time for the rhythm progression does not yet lapse, the CPU advances to the step R6, and detects the on/off state of the play switch S3. When the play switch S3 is again turned on, the steps R6, R11, R12, R13, R9, R20 and R10 are sequentially executed and new data is supplied to the port 9A.

When the tone duration of the musical tone read out from the RAM 3B by the CPU 1 is counted, in the step R20, the judgment of "YES" is made and the CPU 1 advances to the step R17 and the step R19. As a result, the pitch code in the next address of the RAM 3B as the submemory is transmitted to the port 9B, and the melody sound subgenerating section 10B produces a musical tone of the next pitch.

With respect to the rhythm sound, when it is detected that the given time lapses in the step R10, the CPU 1 steps the ROM pointer 1-1 in the step R22 and advances to the step R23 to transfer the rhythm pattern data in the address specified by the ROM pointer 1-1 through the CPU 1 to the port 4. As a result, a new rhythm pattern signal is applied to the rhythm pattern generating section 6, to produce the rhythm sound.

In this way, in the step R13, the address of the RAM 3A as the main memory is stepped, and in the step R21 the address in the RAM 3B as the submemory is stepped. Additionally, the address in the ROM 2 is stepped in the step R22, thereby to perform the one-key play accompanied by the automatic play and the automatic rhythm play.

The case thus far described is that the automatic play and the automatic rhythm play on the basis of the submemory are synchro-started in the one-key play mode dependent on the contents of the main memory. Similarly, the automatic play and the rhythm play on the contents of the submemory may also be synchro-started in the course of the automatic play dependent on the contents of the RAM 3A as the main memory with the storage of the octave, note and tone duration codes for each step, as shown in FIG. 7.

In this case, the slide switch S5 is set in the "READ" mode, and the M1 switch S7 and the M2 switch S8 are operated in this order, as shown in FIG. 6, and then the head switch S4 is turned on to initialize the pointers 1-1 to 1-3, and then the start/stop switch S2 is turned on.

As a result, the CPU 1 executes the process given by the flow chart in FIGS. 5A and 5B. In the step R6, the CPU 1 provides the judgment of "YES" every time the tone duration time corresponding to the tone duration code of the musical tone codes in the main memory is counted and executes the process of the steps R11, R12 and R13 or the R14, R15 and R16.

In the step R6, when the judgment of "NO" is made, the CPU 1 executes the step R7. In the automatic play mode, the judgment of the step R7 is always "NO" and the program execution enters the step R9.

In this way, in the automatic play on the basis of the contents of the main memory, the melody main generating section 10A sequentially and automatically produces the musical tone of the pitches during the corresponding time, as shown in FIG. 8. When the synchro start code is read out from the address location previously set in the RAM 3A, the flip-flop 7 is set in the step R14 to start the supply of the rhythm pattern data from the AND gates 5-1 to 5-N to the rhythm sound generating section 6, thereby to synchro-start the rhythm play. In the step R15, the S flag 1-6 is set to "1" and the automatic play on the basis of the contents of the submemory starts.

The one-key play and the automatic play may be stopped through an external switching operation, for example, the mode changing or the operation of the start/stop switch S2. Additionally, the end code preset in the RAM 3A may be used for the same purpose.

In the above example, the main memory is the RAM 3A and the submemory is RAM 3B. In the present embodiment, however, the allotment of the RAMs to the main and submemories and the execution of the one-key play or the automatic play depending on only the main memory is determined by an operation order of the M1 switch S7, the M2 switch S8 and the head switch S4.

When, after the slide switch S5 is set to the "READ" position, the M1 switch S7 and the head switch S4 are operated in this order, the contents of the M1 flag 1-4 in the CPU 1 is all "1's" and the M2 flag 1-5 is all "0's". The CPU 1 controls so that the performance on the basis of only the contents of the RAM 3A is executed.

When the M2 switch S8 and the head switch S4 are operated in this order, the M1 flag 1-4 has all "0's" and the M2 flag 1-5 has all "1's", so that the CPU 1 controls so that the performance only by the RAM 3B is executed.

When the M1 switch S7, the M2 switch S8 and the head switch S4 are operated in this order, the M1 flag 1-4 has all "1's" and the M2 flag has "1000", so that the CPU 1 selects the RAM 3A for the main memory and the RAM 3B for the submemory, under this condition a corresponding musical tone is produced.

When the M2 switch S8, the M1 switch S7 and the head switch S4 are operated in this order, the M1 flag has "1000" and the M2 flag has all "1's", so that the CPU 1 selects the RAM 3B for the main memory and the RAM 3A for the submemory, and under this condition a corresponding musical tone is produced.

In the above-mentioned embodiment, only the pitch code or the pitch code and the tone duration code, together with the synchro start code, are stored in the RAMs 3A and 3B through the operation of the keyboard 12-1 and the switch section 12-2. These codes may directly be inputted into the memories 3A and 3B externally by means of a magnetic card, a paper tape, a RAM package, or a bar code. If so done, the setting time and work for those data are reduced, compared with the setting of a musical piece by the keyboard 12-1 and the switch section 12-2.

While the above-mentioned embodiment employs the push button switch for the synchro start switch S1, a specific key on the keyboard 12-1 may be used designed to have the function of the switch.

In the above-mentioned embodiment, the synchro-started rhythm play is performed upon the selection by the rhythm select switch S6 during the course of the automatic play or the one-key play. Alternatively, the data to designate desired rhythm patterns for the rhythm play may be preset in the RAMs 3A and 3B and the type of the rhythm pattern used after the synchro start is made is specified.

Further, in the above-mentioned embodiment, the two RAMs are used: one for the main memory and the other for the submemory or vice versa, depending on the switching operation. It is evident, however, that those memories may be fixedly allotted to the main memory and the submemory.

The two memories RAMs 3A and 3B which are used in the above-mentioned embodiment may be replaced by a single RAM when its memory area is used divided into two sections. Further, the number of submemories is not limited to one.

For storing the chcrd data as the musical tone data into the memory, the rhythm play and the chord play may simultaneously be started in the one-key play mode or the automatic play mode. FIG. 10 shows a data format stored in the memory in such a case. The musical tone codes ranging from the memory area where the chord flag is "1" to the memory area where the chord flag is "1" are simultaneously read out, and the read out ones are supplied to the melody tone subgenerating section 10B, thereby to produce the chord. For example, when the C4, E4 and G4 are simultaneously produced, the chord of Cmaj is produced. FIG. 11 illustrates an output state of the chord performance. In another format for storing such chords, chord data including codes representing roots of the chords and codes representing of the kinds (major, minor, seventh, etc.) and data representing the time duration of the chord is gathered into a unit data and the unit data is stored into the memory.

In another modification of the present embodiment, the melody tone main generating section 10A and the melody tone subgenerating section 10B may be substituted by a single musical tone generating circuit which is operable in a time division manner.

It should be understood that the present invention may be modified variously within the scope of the present invention.

As described above, the musical tone codes and the synchro start code are stored in a plurality of memories. Of these memories, one memory is used for the main memory. The one-key play or the automatic play is performed on the basis of the contents of the main memory. When the synchro start code is read out from the main memory, the automatic play on the basis of the submemory is started. This enables a player to play an ensemble of melody and melody or an ensemble of melody and chord at any point in a musical piece. Consequently, the one-key play or the automatic play is more natural, with a player enjoying music play.

Moreover, when the synchro start code is read out, the rhythm play on the basis of the rhythm pattern selected as synchro-started in addition to the automatic play, more effective play is obtained.

What is claimed is:

1. A synchro start device for an electronic musical instrument comprising:

memory means including a plurality of memory areas, each memory area being capable of storing musical tone codes representing musical tones sequentially, each memory area having a plurality of memory locations;

setting means for setting a specific memory area of the plurality of memory areas as a main memory area;

inputting means for inputting a synchro start code at a specified location in said main memory area;

first means for reading out musical tone codes and a synchro start code from said main memory area;

second means for starting to read out musical tone codes sequentially from a memory area other than said main memory area when said synchro start code is read out from said main memory area by said first means; and automatic playing means for performing an automatic play of the electronic musical instrument in accordance with said musical tone codes read out by said first and second means.

2. The synchro start device of claim 1, further comprising automatic rhythm play means responsive to said reading out of said synchro start code for starting rhythm play of said instrument when said synchro start code is read out from said main memory area by said first means.

3. The synchro start device of claim 1 or 2, wherein said inputting means includes a manually operable switch, and said synchro start code stored in said main memory area is set through manual depression of said switch.

4. The synchro start device of claim 1, wherein:

said first means includes a control key for stepping an address of said main memory area at every operation of said control key to read out a pitch code as said musical tone code and to read out said synchro start code from said main memory area; and said automatic playing means includes means for producing a musical tone in accordance with said pitch code during a time period that said control key is depressed, said automatic play on the basis of said second means being started when said synchro start code is read out from said main memory area by means of said first means.

5. The synchro start device of claim 3, further comprising automatic rhythm play means including means responsive to said synchro start code being read out from said main memory area by said first means for starting an automatic rhythm play on said instrument.

6. The synchro start device of claim 1, wherein:

said musical tone codes include tone duration codes of a musical tone and pitch codes of the musical tone which are stored in said main memory area;

said synchro start code being stored at a memory location specified;

said first means including means for reading out said pitch codes and said tone duration codes sequentially; and said automatic playing means includes means for producing musical tones for a time duration in accordance with said tone duration codes, said automatic play on the basis of said second means being started when said synchro start code is read out from said main memory area by means of said first means.

7. The synchro start device of claim 5, further comprising automatic rhythm play means including means responsive to said synchro start code being read out from said main memory area by said first means for starting an automatic rhythm play on said instrument.

8. The synchro start device of claim 1 or 2, wherein said first means reads out said tone codes sequentially from said main memory area.

9. The synchro start device of claim 1 or 2, wherein said setting means fixedly sets a specific memory area of the plurality of memory areas as said main memory area.

10. The synchro start device of claim 1 or 2, wherein said setting means variably sets a specific memory area of the plurality of memory areas as said main memory area.

11. The synchro start device of claim 1 or 2, wherein said second means starts to read out said musical tones after said synchro start code and tone codes are read out by said first means.

12. The synchro start device of claim 3, wherein said second means starts to read out said musical tones after said synchro start code and tone codes are read out by said first means.

13. The synchro start device of claim 1 or 2, wherein said instrument is a keyboard electronic musical instrument.

* * * * *

UNITED STATES PATENT AND TRADEMARK OFFICE

CERTIFICATE OF CORRECTION

PATENT NO. : 4,413,543

DATED : November 8, 1983

INVENTOR(S) : Akio IBA

It is certified that error appears in the above-identified patent and that said Letters Patent is hereby corrected as shown below:

Column 1, lines 9-10, "In this the musical instrument,"

should read --In this type of musical instrument,--;

Column 1, line 19, "...is thus far provided not in"

should read --...is thus far not provided in--;

Column 1, line 27, "Therefore, the performance..."

should read --Therefore, performance...--.

Signed and Sealed this

*Fifteenth* Day of *May 1984*

[SEAL]

*Attest:*

GERALD J. MOSSINGHOFF

*Attesting Officer*

*Commissioner of Patents and Trademarks*